US007677152B2

(12) United States Patent
Rajalin et al.

(10) Patent No.: US 7,677,152 B2
(45) Date of Patent: Mar. 16, 2010

(54) MOTORCYCLE EQUIPPED WITH A WEAPON

(76) Inventors: Tom Rajalin, Luoteisväylä 26 B 37, FI-00200 Helsinki (FI); Mikko Helkama, Engelinaukio 11, FI-00150 Helsinki (FI)

( * ) Notice: Subject to any disclaimer, the term of this patent is extended or adjusted under 35 U.S.C. 154(b) by 183 days.

(21) Appl. No.: 10/592,263

(22) PCT Filed: Mar. 9, 2005

(86) PCT No.: PCT/FI2005/050070

§ 371 (c)(1),
(2), (4) Date: Jul. 12, 2007

(87) PCT Pub. No.: WO2005/088228

PCT Pub. Date: Sep. 22, 2005

(65) Prior Publication Data

US 2007/0278764 A1 Dec. 6, 2007

(30) Foreign Application Priority Data

Mar. 11, 2004 (FI) ..... 20045071

(51) Int. Cl.
*F41A 23/38* (2006.01)

(52) U.S. Cl. ..... 89/40.04

(58) Field of Classification Search ..... 89/40.04; 42/94; 280/277
See application file for complete search history.

(56) References Cited

U.S. PATENT DOCUMENTS 526,680 A * 10/1894 Breire ..... 89/40.04
615,179 A * 11/1898 Horner ..... 89/13.05
1,273,178 A * 7/1918 Perry et al. ..... 89/40.04
1,273,179 A * 7/1918 Perry et al. ..... 89/40.04
1,876,995 A * 9/1932 Manzer ..... 89/40.04
2,085,024 A * 6/1937 Johnston ..... 89/40.04
2,377,838 A * 6/1945 Collings ..... 180/9.42
2,407,884 A * 9/1946 Johnston ..... 89/40.04
3,806,010 A * 4/1974 Utigard ..... 224/421
4,823,673 A * 4/1989 Downing ..... 89/37.04
4,915,273 A 4/1990 Allen
5,697,181 A * 12/1997 Savant ..... 42/94

(Continued)

FOREIGN PATENT DOCUMENTS

BE 341651 B 5/1927

(Continued)

OTHER PUBLICATIONS

International Search Report mailed Jul. 18, 2005 issued in PCT Application No. PCT/FI2005/050070.

*Primary Examiner*—Bret Hayes
(74) *Attorney, Agent, or Firm*—Drinker Biddle & Reath LLP

(57) ABSTRACT

A motorcycle, which is equipped with a weapon, as well as with a front and rear wheel or a front ski and a rear-located track mat. The motorcycle includes a chassis member, a front frame, a handlebar, and a pivoting device fitted between the handlebar and the front wheel or ski. The pivoting device includes connecting mechanism including switch-over elements whereby the weapon is connectable to the handlebar for directing it in a lateral direction by turning motions of the handlebar or disconnectable from this engagement with the handlebar to use the handlebar for steering the motorcycle.

10 Claims, 10 Drawing Sheets

U.S. PATENT DOCUMENTS

| | | | | |
|---|---|---|---|---|
| 6,634,530 | B1 * | 10/2003 | Black | 224/401 |
| 6,793,108 | B2 * | 9/2004 | Williams, Jr. | 224/401 |

FOREIGN PATENT DOCUMENTS

| | | | |
|---|---|---|---|
| CH | 15673 | A | 12/1897 |
| DE | 412304 | | 4/1925 |
| GB | 5004 | A | 6/1916 |
| GB | 543026 | | 2/1942 |
| GB | 551504 | | 2/1943 |
| NL | 1614 | | 6/1915 |

* cited by examiner

MOTORCYCLE EQUIPPED WITH A WEAPON

The present invention relates to a motorcycle, which is equipped with a weapon, as well as with a front and rear wheel or a front ski and a rear-located track mat, said motorcycle comprising a chassis member, a front frame attached to the chassis member, a handlebar, pivoting means fitted between the handlebar and the front wheel or ski, and by which pivoting means the turning motions of the handlebar are transmissible to the front wheel or ski for steering the motorcycle.

A vehicle equipped with a weapon, such as a rifle, is prior known e.g. from U.S. Pat. No. 5,697,181. The vehicle can be a motorcycle with the rifle mounted on a bracket secured to the vehicle's handlebar. The bracket is provided with a pivot and allows for rotation of the rifle and directing it obliquely up and down. According to the publication, the objective here is to bring the weapon, regardless of the shape of a handlebar, along a proper line in a safer position during drive and hence to protect the driver.

In addition, U.S. Pat. No. 4,915,273 discloses a bow-weapon or rifle holding mechanism mounted on the handlebar of a motorcycle.

The above-disclosed weapon attachment mechanisms do not permit the use of a weapon while the weapon is secured thereto. Furthermore, the attachment mechanisms are suitable for relatively light weapons, which are used principally in hunting and which do not have much destruction power in warfare.

Moreover, vehicles designed for carrying heavier weapons with more destruction power and personnel, such as armoured carriages or cars, are clumsy and unfit for difficult off-road conditions. In addition, heavy-duty transport vehicles do not allow much of a surprise in a combat situation or in a nuisance or destruction raid. They are easy to detect on the basis of thermal radiation and commotion. A single hit by the enemy may be enough to destroy the vehicle, crew, and armament.

It is an object of the present invention to eliminate or substantially mitigate the above drawbacks.

Motorcycles advance nimbly and quickly on off-road terrain. They produce a negligible amount of thermal radiation. They are almost as quiet as a combatant advancing on foot. While advancing, they can spread out over several square kilometers. They are able to carry e.g. heavy machine guns, automatic grenade launchers, bazookas and missiles. The above aspects result in high firepower, quick and agile mobility, as well as an element of surprise. They are difficult to detect and, hence, to destroy. They are inexpensive to acquire and maintain.

According to the present invention, the above inventive object is accomplished in such a way that the pivoting means are provided with suspension elements for a weapon, by which the weapon is connected to the pivoting means for directing it by the handlebar, and that the pivoting means include a connecting mechanism, comprising switch-over elements whereby the weapon is connectable to the handlebar for directing it in a lateral direction by turning motions of the handlebar or disconnectable from this engagement with the handlebar to use the handlebar for steering the motorcycle.

This gives the advantage that the switch-over elements can be used for disconnecting a lateral alignment of the weapon in a very simple manner and quickly from the handlebar during transport and, when necessary, for coupling quickly with the handlebar used for directing the weapon. Since, according to the invention, the lateral mass of a weapon can be disconnected from the handlebar during the course of driving, it shall not interfere with steering, thus making it possible to increase the size and weight of a weapon. This results in a further improvement regarding destruction power and element of surprise, as the weapon can be transported without committing heavy-duty equipment or troops.

Preferred embodiments of the present invention are set forth in the dependent claims.

The present invention will now be described more closely with reference to the accompanying drawings, in which.

Figure 1A:
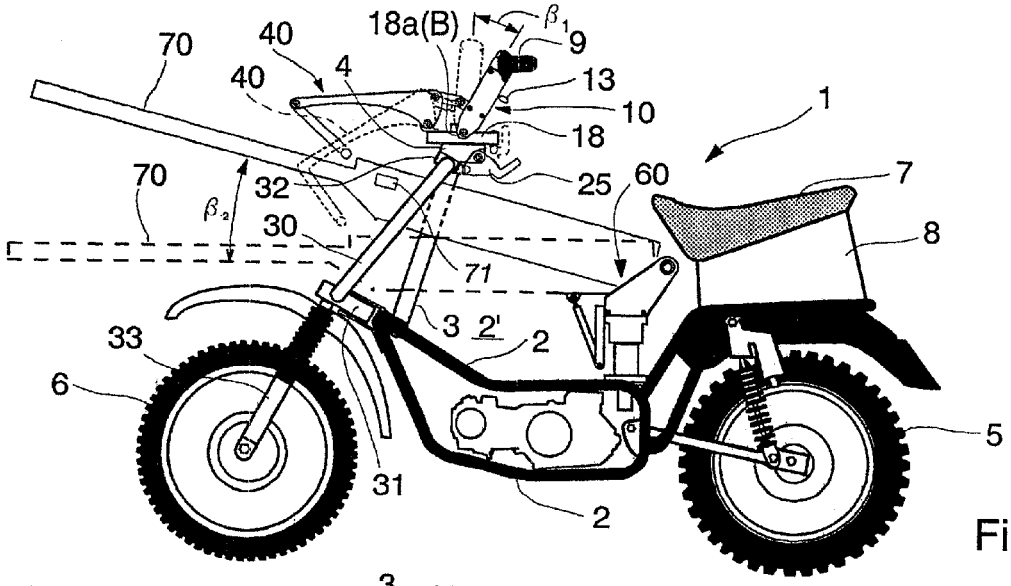
FIG. 1A shows a motorcycle of the invention in a side view.
Figure 1B:
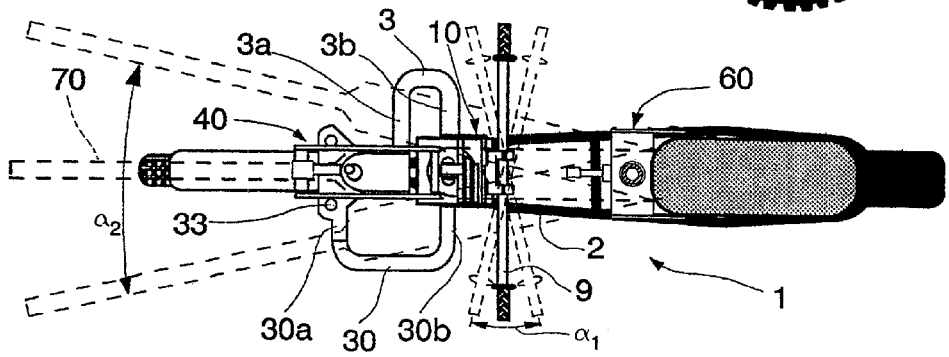
FIG. 1B shows a motorcycle of the invention in an overhead view.
Figure 1C:
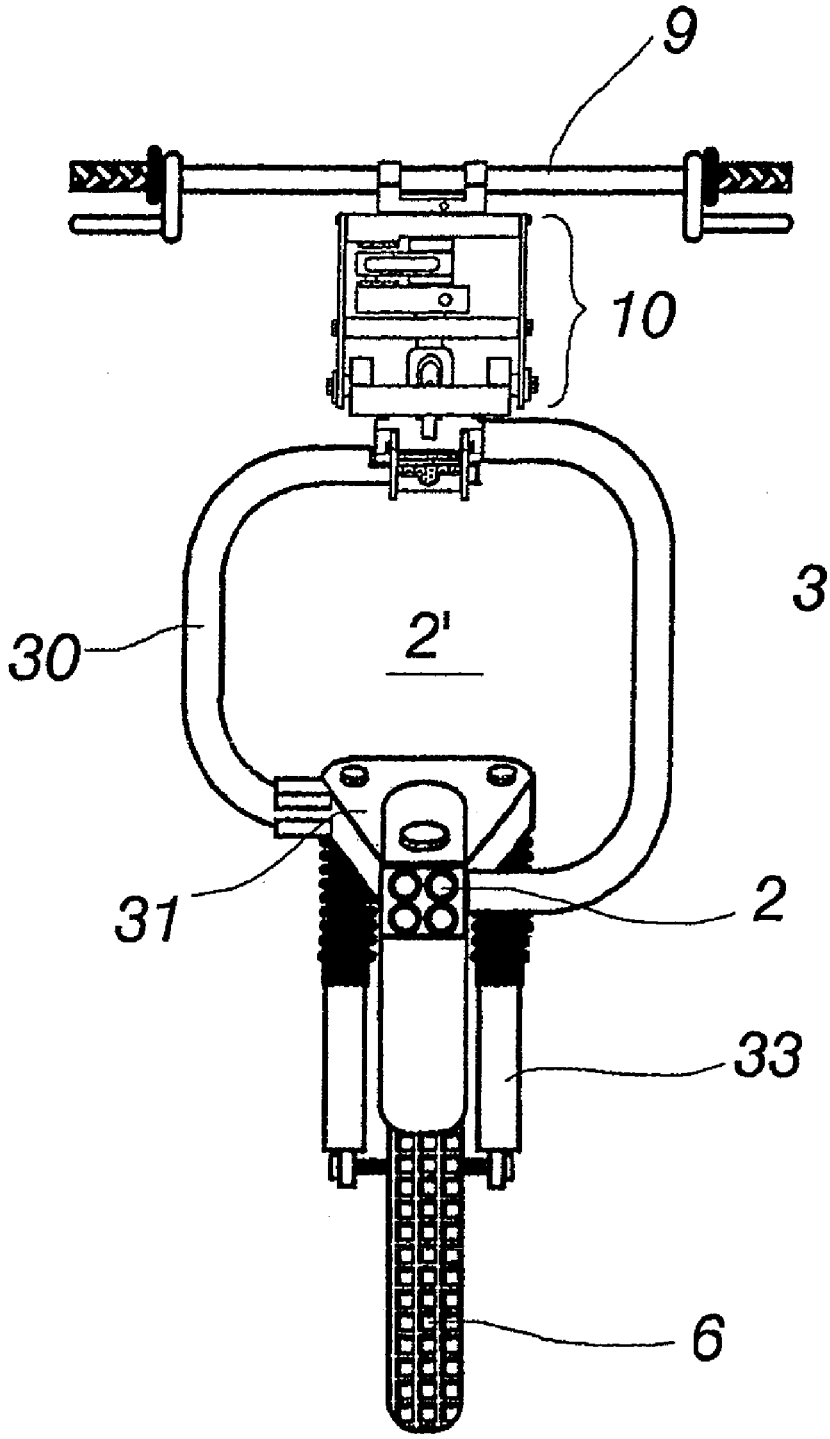
Figure 2:
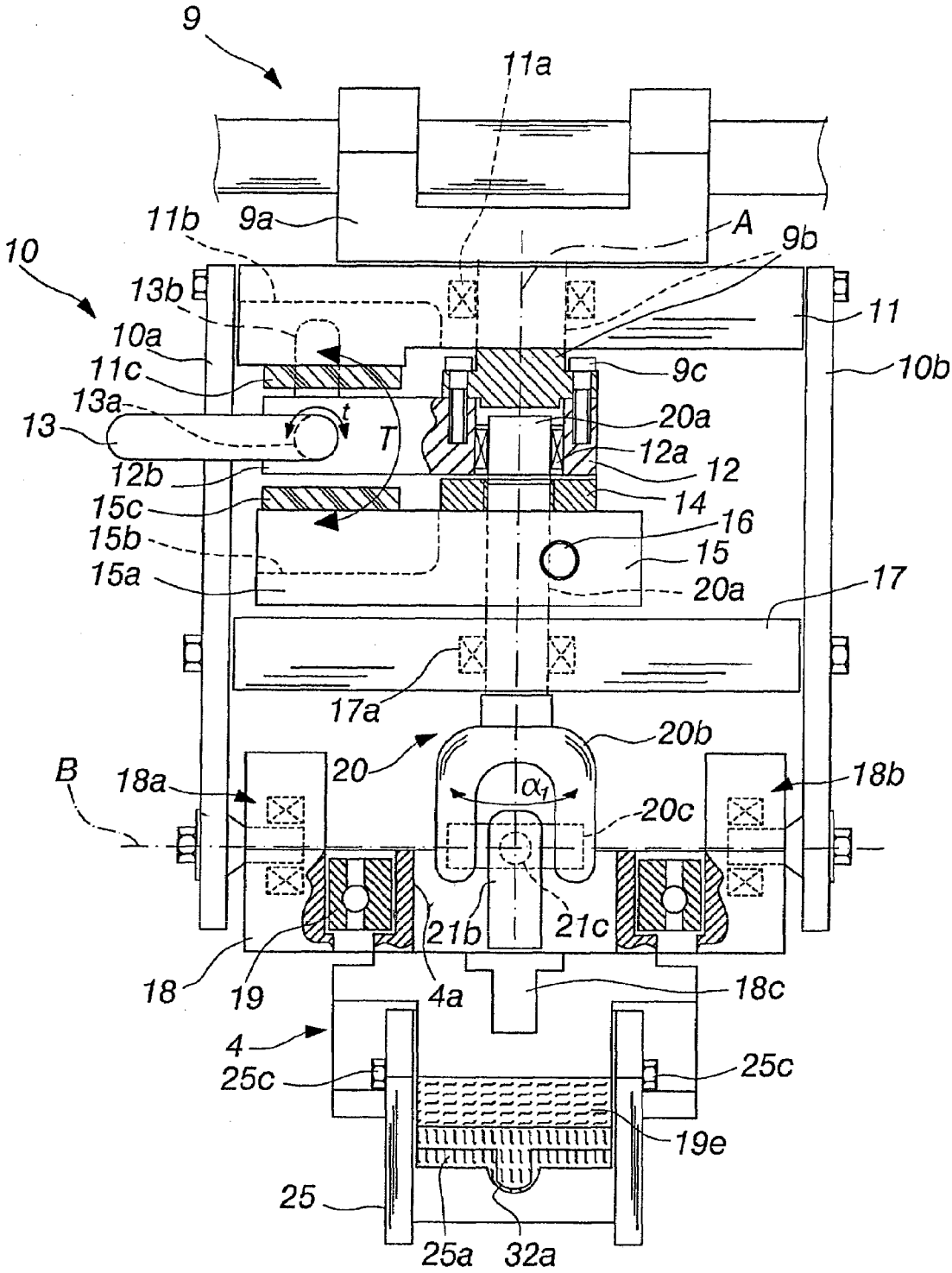
Figure 3:
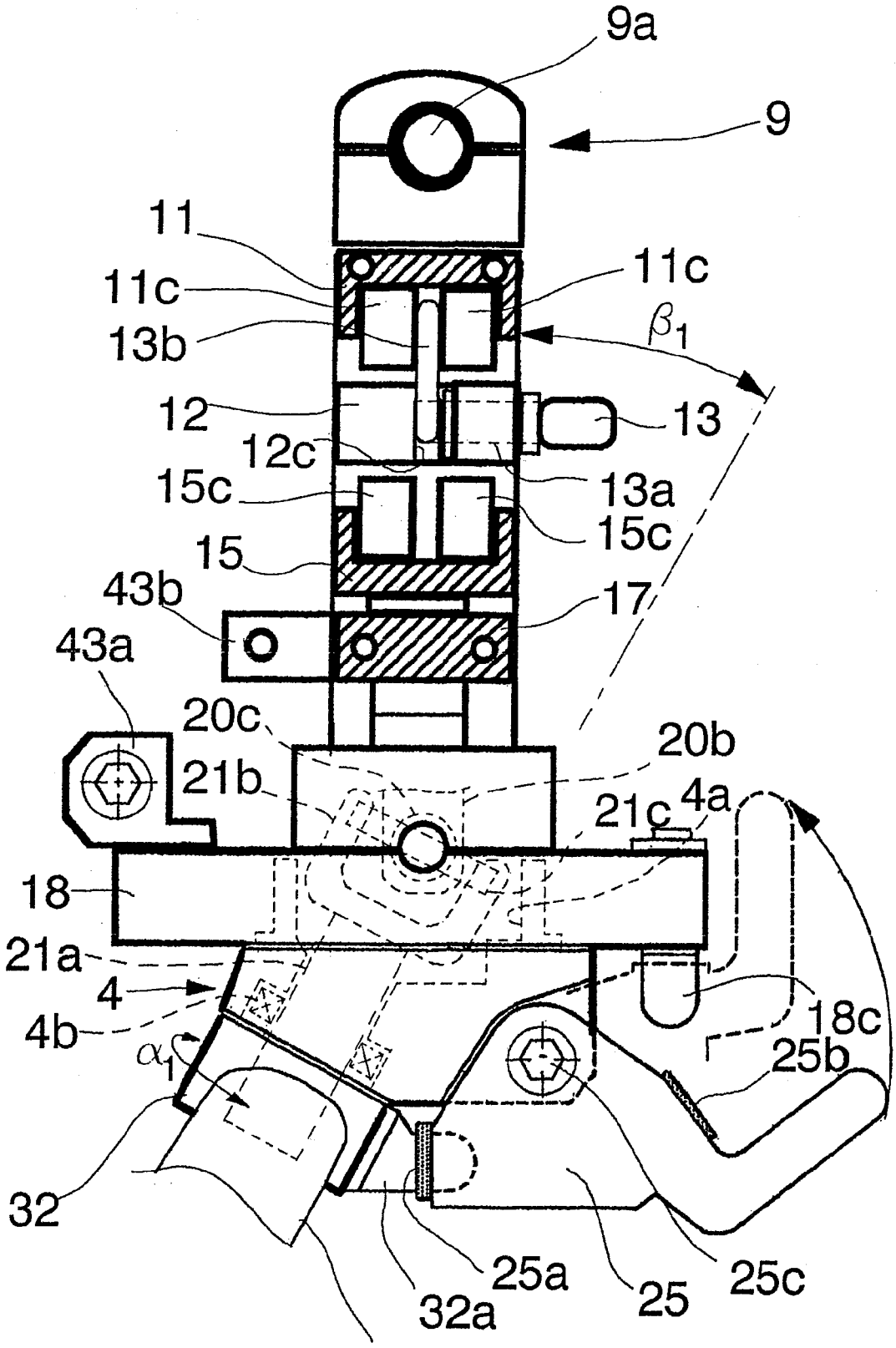
Figure 4:
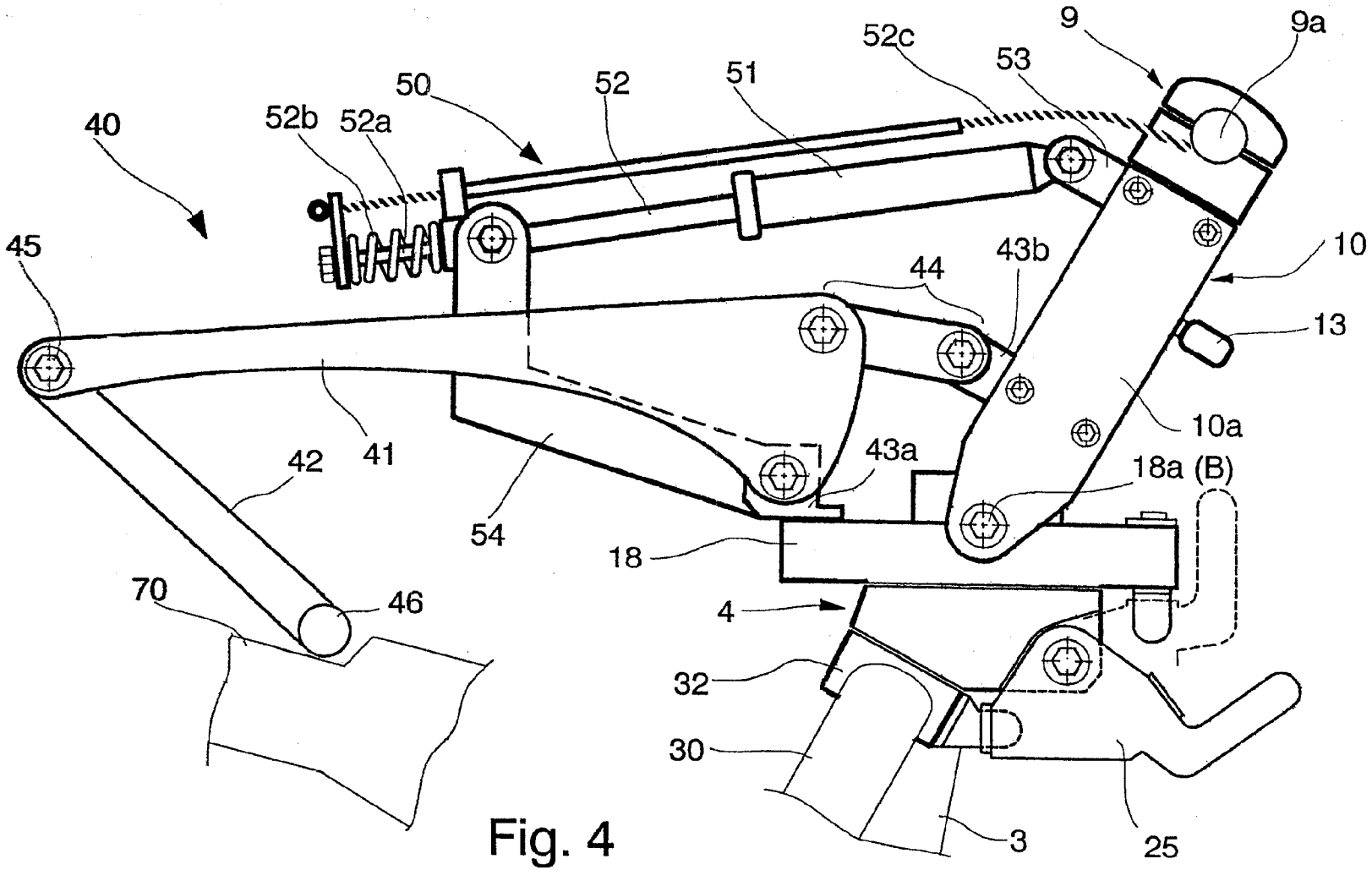
Figure 5A:
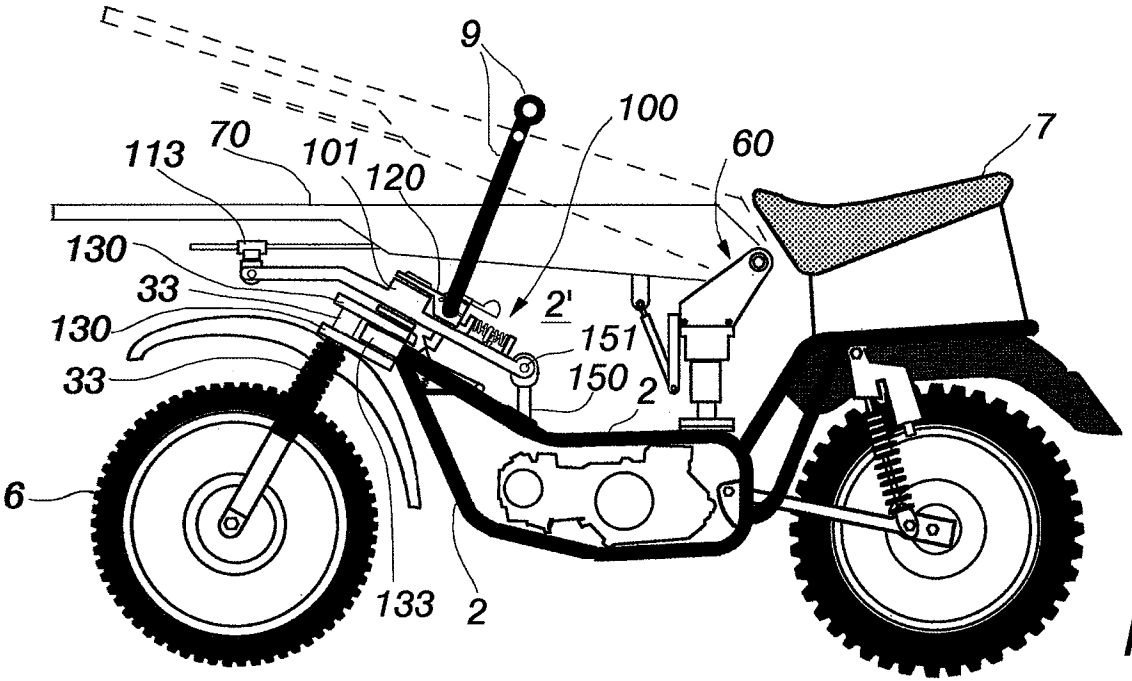
Figure 5B:
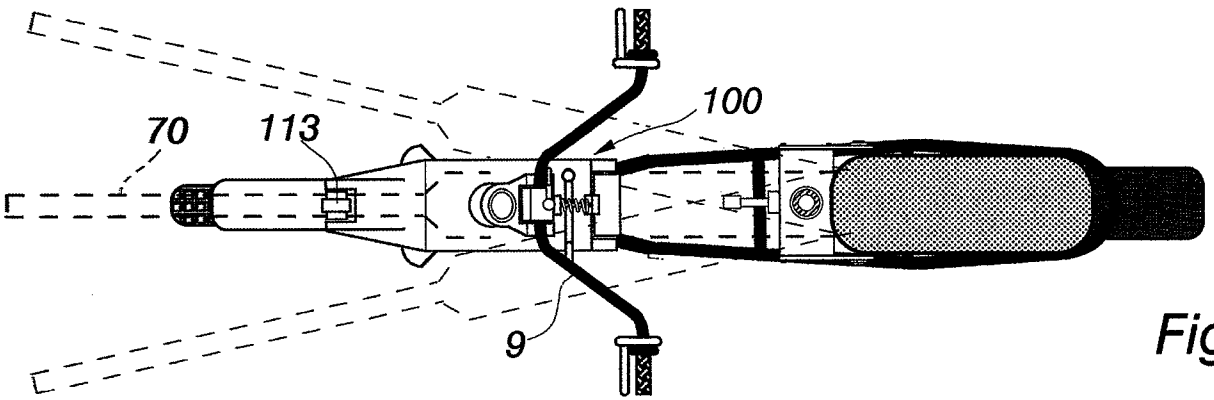
Figure 5C:
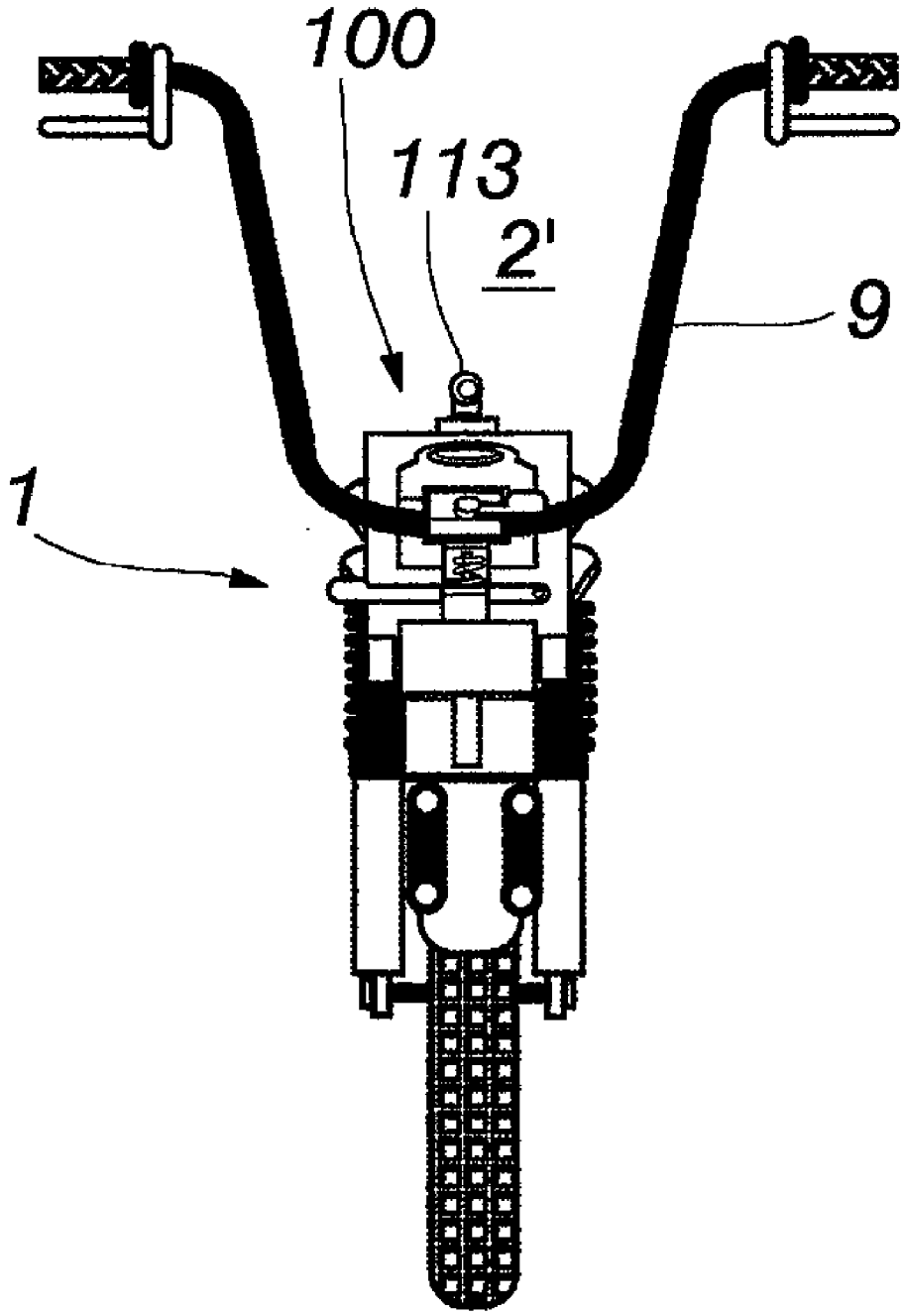
Figure 6:
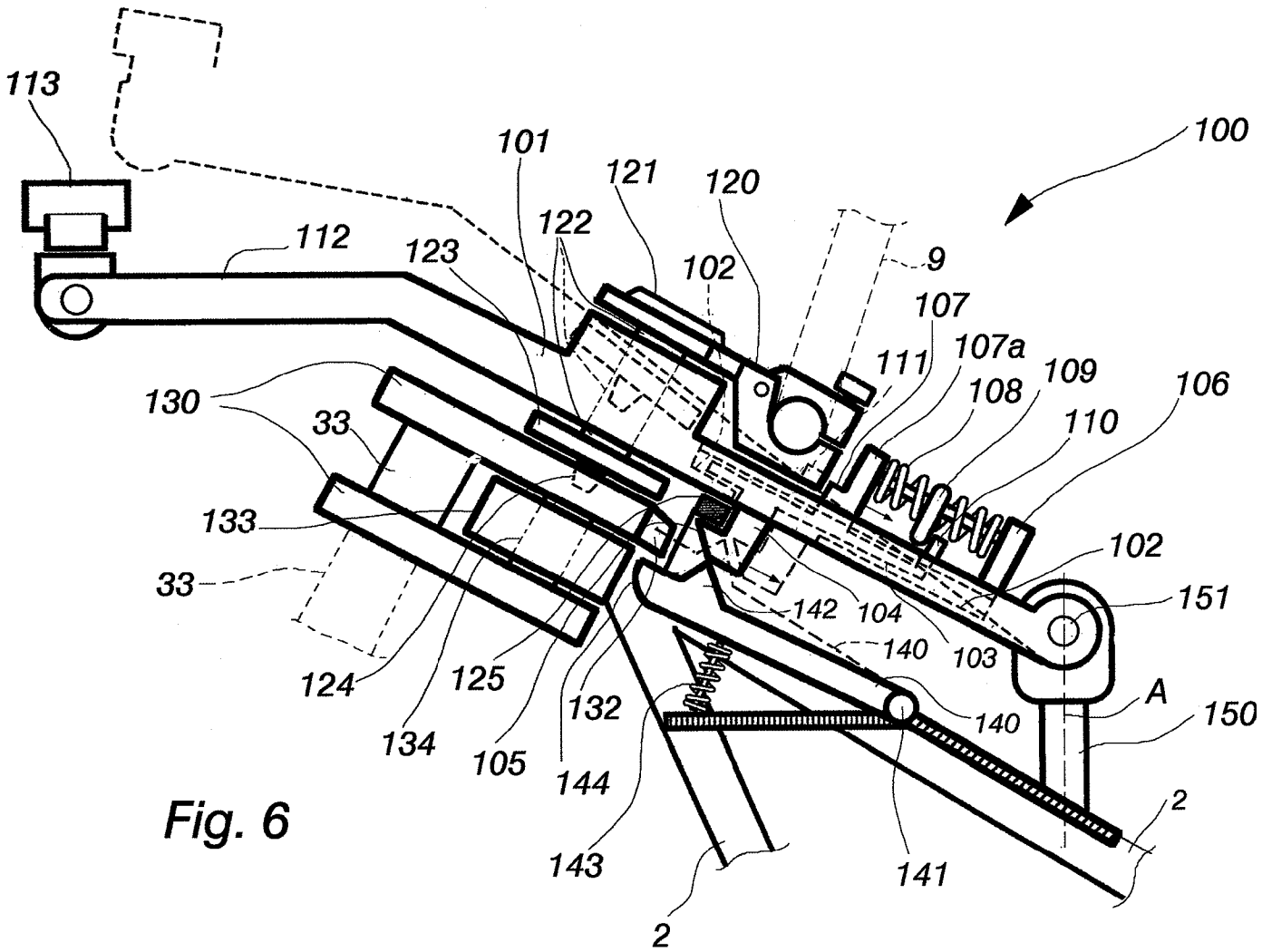
Figure 7:
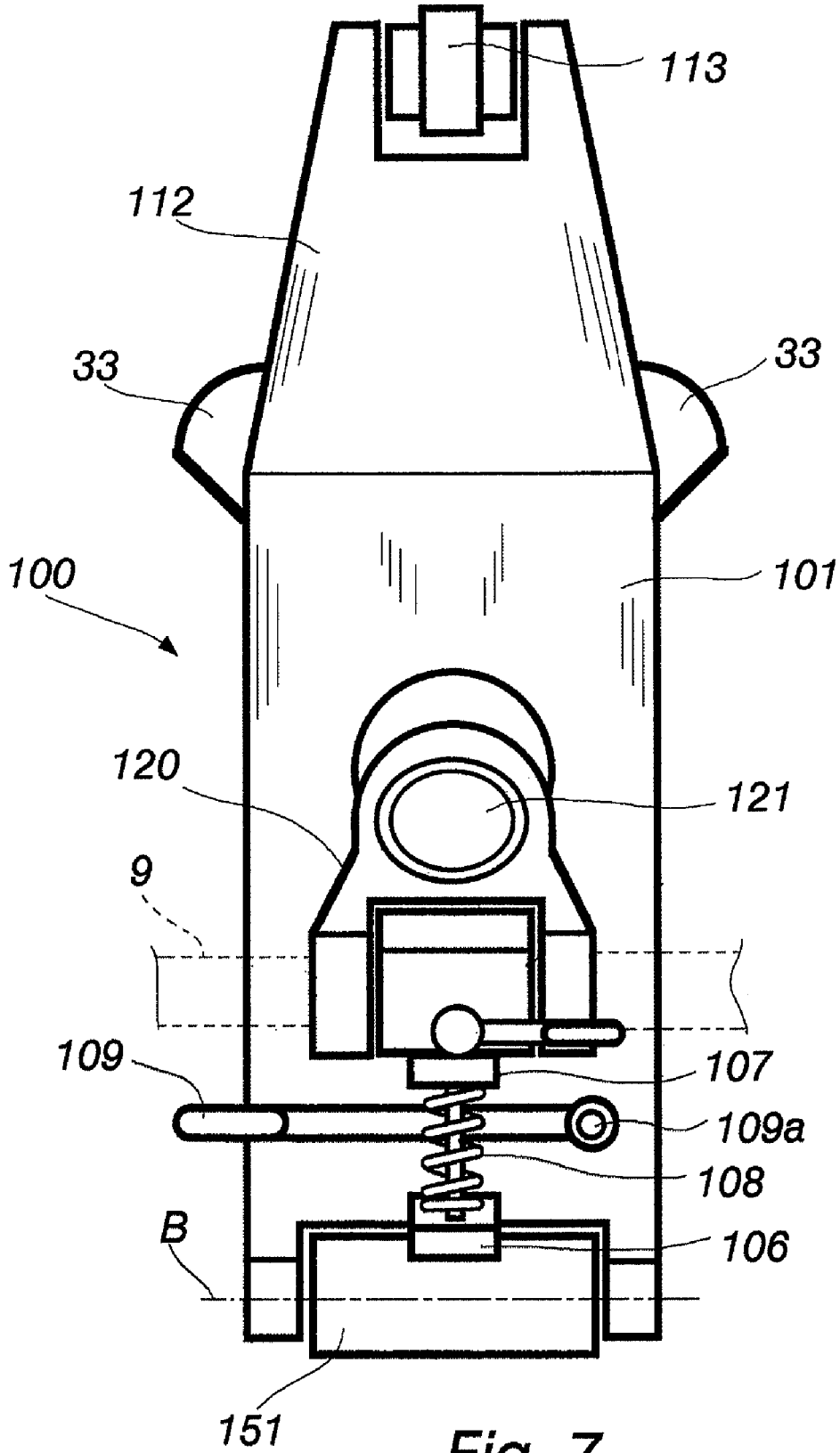

FIG. 1C shows a section taken along a line behind a front wheel 6 and a handlebar 9 in FIG. 1A, FIG. 2 shows a connecting mechanism in a front view, FIG. 3 shows a connecting mechanism in a side view, FIG. 4 shows suspension elements for a weapon in a side view, FIG. 5A shows a motorcycle of a second embodiment in a side view, FIG. 5B shows the motorcycle of FIG. 5A in an overhead view, FIG. 5C shows a section taken along a line behind a front wheel and a handlebar, FIG. 6 shows a connecting mechanism of a second embodiment in a side view, and FIG. 7 shows a connecting mechanism of the second embodiment in an overhead view.

Figure 8:
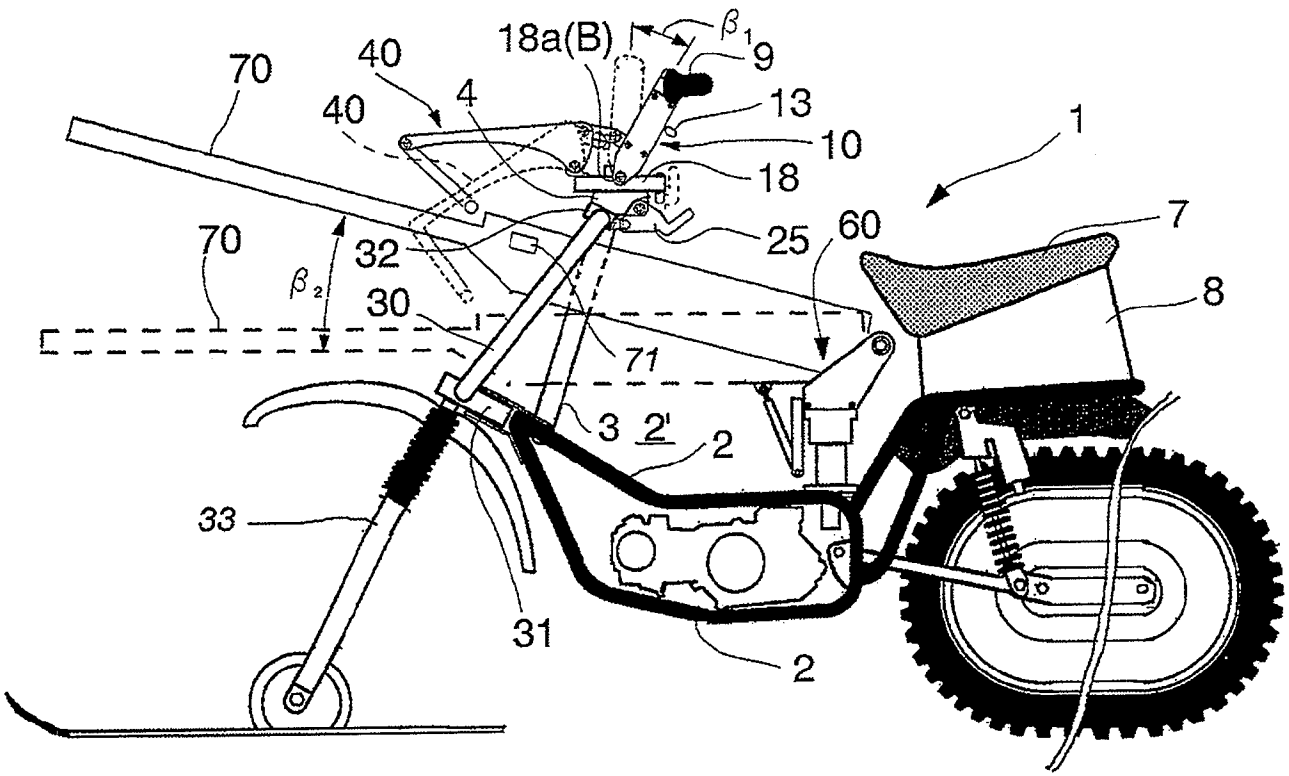

FIG. 8 shows an alternative motor cycle of the invention showing the front ski in a side view.

Accordingly, FIGS. 1A and 1B illustrate a motorcycle of the invention in general design at reference numeral 1. The motorcycle 1 comprises a preferably frame-like chassis member 2, which is low-mounted and has its rear section fitted with a rear tire 5 and a seat member 7. Between the rear tire 5 and the seat member 7 is preferably fitted a fuel tank 8 or another energy-supply storage element, such as a battery. This results in a void space 2' in front of the seat 7. The motorcycle 1 has its engine fitted within the chassis member 2.

The chassis member 2 has its forward part provided with a front frame 3 and 4, which is associated with pivoting means 10, 30, 33 adapted to be movable relative to the front frame 3, 4. The pivoting means 10, 30, 33 are in turn fitted essentially between a handlebar 9 and a front tire 6, whereby turning motions (indicated in FIG. 1B with reference character $\alpha$1) of the handlebar 9 about a trunnion are transmitted during the course of driving (transportation of a weapon) to the front wheel 6 for steering the motorcycle 1. The front frame 3, 4 includes a connecting link 3, having its bottom end 3*a* and top end 3*b* bent laterally relative to the longitudinal axis of the chassis member 2, whereby the section remaining therebetween and extending substantially upwards from the chassis member 2 is located at a distance from the longitudinal axis of the chassis member 2. This distance is preferably about 20-50 centimeters. At the end of the upper lateral link 3*b*, in the same vertical plane with respect to the longitudinal axis of the chassis member 2, is mounted a bearing seat 4, whose structure and function will be described more specifically hereinbelow. The pivoting means 10, 30, 33 in turn include a front fork 33 associated with the front tire 6. The front fork 33 has a substantially upward-pointing extension in the form of a second connecting link 30, which is connected at its bottom portion 30*a* to the chassis 2 by way of a bearing 31. By its top portion 30*b*, the connecting link 30 is in contact with an articulated shaft 20, 21 (see FIG. 3), which is extended through the bearing seat 4 and constitutes part of a connecting mechanism 10 included in the pivoting means. The structure and function of the connecting mechanism in one preferred embodiment will also be described more specifically hereinbelow.

The second connecting link 30 has its bottom and top ends 30*a* and 30*b* bent in a lateral direction the same way as the connecting link 3 included in the front frame 3, 4, but in the opposite direction. Thus, the area between the chassis member 2 and the bearing seat 4, as well as between the connecting links 3 and 30, constitutes an opening, i.e. a vacant space. This enables a relatively large weapon 70 to be brought through the opening, with some horizontal and vertical clearance still left for directing the weapon. The weapon can have its rear portion set on its mounting 60 fitted within a space 2' provided in front of the seat 7. The weapon 70 can have its rear portion preferably raised or lowered in a substantially vertical direction by means of a lifting cylinder or the like hoisting device included in the mounting. The weapon 70 has its forepart positioned forward of the motorcycle 1.

For this purpose, the weapon 70 is suspended at a location forward of the handlebar 9 by means of suspension elements 40, 50 linked to the connecting mechanism 10. According to one preferred embodiment, a tank 8 can be mounted for example on top of the chassis member 2, whereby the weapon 70 can have its rear portion extended through an opening left between the seat 7 and the rear tire 5.

The structure and collaboration of the connecting mechanism 10, the bearing seat 4, and the bracket elements 40 can be appreciated by examining FIGS. 2-4. The connecting mechanism 10 comprises two opposite, spaced-apart flat type base elements 10*a* and 10*b*. Between the base elements 10*a* and 10*b*, at the end closer to the handlebar 9, is fitted an elongated crossbar 11, having a trunnion 9*b* for the handlebar 9 passed therethrough and bearing-mounted for rotation around its rotation axis A by means of a bearing 11*a* fitted on the crossbar 11. Further, between the base elements 10 and 10*b*, at the other end relative to the handlebar 9, is fitted an annular bracing element 18, having the base elements pivotably attached thereto by means of bearings 18*a* and 18*b* mounted on the bracing element 18. Consequently, the entire connecting mechanism 10 can be pivoted by turning manually the handlebar 9 about a second pivot axis B extending through the bearings 18*a* and 18*b*. In addition, between a bush-like top portion of the bearing seat 4 and the bracing element 18 is provided a bearing 19, which enables swivelling the bracing element 18 and the connecting mechanism 10 associated therewith about the rotation axis A.

A first bracket 12 extending towards the base element 10*a* is secured by means of fastening members, such as screws 2*a*, to the bottom part of the trunnion 9*b* for rotation along with the trunnion 9*b*. The first bracket 12 has its end 12*b*, which extends to the proximity of the base element 10*a*, formed with a slot 12*c* having a lug-shaped gripper 13*b* arranged therein. In this embodiment, the gripper 13*b* is adapted to turn (double arrow T in FIG. 2) in response to a turning motion t performed by a toggle-like manually operated reversing switch 13 linked thereto by way of a trunnion 13*a*. The gripper 13*b* can also have its movement actuated by hydraulic, pneumatic and/or electric pivoting means and the movement can be made for example linear. The turning motion according to the illustrated embodiment is preferably 180°. In FIGS. 2 and 3, the gripper 13*b* is shown in a position set in contact with a first response element 11*c* formed on the crossbar 11. The response element 11*c* consists preferably of two rubber pads 11*c* fitted in a pocket 11*b* formed in the crossbar 11. Between the rubber pads 11*c* is left a slot, in which the gripper 13*b* can be brought in response to the reversing switch 13 for engagement. The engagement can be established also by applying other common engagement/holding arrangements, such as snap coupling.

Adjacent to the trunnion 9*b*, as an elongated extension of the trunnion 9*b*, is provided an articulated shaft 20, 21. The articulated shaft comprises a first shaft member 20 and a second shaft member 21, which are articulated pivotably relative to each other by means of respective pivot joints 20*c* and 21*c*. The first shaft member has the end of its rod 20*a* fitted in a bearing 12*a* mounted on the first bracket 12, such that the first shaft member 20 rotates in a longitudinal sense about the same rotation axis A as the trunnion 9*b*. In connection with the shaft member 20 is fitted a second bracket 15, which is provided with a cotter pin clamp 16 for keeping the shaft member 20 and, thus, the articulated shaft 20, 21 stationary in a longitudinal sense of the rotation axis A. The second bracket 15 also includes an end 15*a*, extending to the proximity of the base element 10*a* and formed with a second response element 15*c* for receiving the gripper 13*b* pivotable as indicated by an arrow T shown in FIG. 2. The section left between the first bracket 12 and the second bracket 15 along the rod 20*a* of the first shaft member 20 is provided with an adjustment nut 14 or the like. The adjustment nut 14 can be used for adjusting the articulated shaft's 20, 21 position in a longitudinal sense of the rotation axis A. Underneath the second bracket 15, between the base elements 10*a* and 10*b*, is provided a third base element 17, 43*b*, the purpose of which is primarily to function as a support for coupling the suspension elements 40 of the weapon 70 with the connecting mechanisms 10.

In the present embodiment, the joint 20*c* provided on the shaft member's 20 articulation end 20*b* is located in a longitudinal sense of the rotation axis A to be substantially coplanar with the second rotation axis B. Rotation of the shaft member 20 means that the joint 20*c* also rotates in a plane defined by the second rotation axis B. A second shaft member 21*a* is coupled with the first shaft member 20 by means of a joint 21*c* provided on an articulation end 21*b*. The second shaft member 21 has its articulation end 21*b* fitted in a recess 4*a* provided essentially in the upper portion of the bearing seat 4 and the rod 21*a* is passed through the lower portion of the bearing seat 4. The bearing seat has its lower portion provided with a bearing 4*b*, which enables rotation of the rod member 21*a* relative to the bearing seat 4. The rod member 21*a* has its end provided with a joint member 32, which is capable of rotating with the rod member 21*a* and in turn coupled with the second connecting link 30.

FIG. 4 illustrates one preferred embodiment of the suspension elements 40, by which the weapon 70 is coupled with the connecting mechanisms 10. The suspension elements include two link arms 41 and 42, which are connected to each other by means of pivot joints 45. The first link arm 41 is connected at one of its ends to a joint member 43*a* secured to the bracing element 18 included in the connecting mechanism 10. In addition, the link arm 41 is connected over the top of a joint member 43*b* by way of an intermediate link 44 to the above-mentioned third base element 17. The second link arm 42 has its other end provided with attachment elements 46 for securing the weapon 70 to the suspension elements 40.

The above description has principally dealt with structural aspects of the connecting mechanism 10 included in a motorcycle, especially in the front end thereof. The description shall now be directed more thoroughly to the connecting mechanism 10 in terms of its functional aspects.

Hence, in FIGS. 1A-4, the connecting mechanism 10 has its gripper 13*b* coupled in engagement with the first response element 11*c* provided on the crossbar 11. Thus, the swivel motional α1 of the trunnion 9*b* of the handlebar 9 about the rotation axis A is transmitted to the first mounting bracket 12 and further by way of the gripper 13*a* to the crossbar 11, the base elements 10*a* and 10*b*, as well as to the third bracket 17 and the bracing element 18. The suspension elements 40 for the weapon 70, which are connected as described above to the third bracket 17 and the bracing element 18, and the weapon 70 itself are capable of turning in a lateral direction across a deflection angle α2 corresponding to the swivel motion α1 of the handlebar 9 and the trunnion 9*b*. By virtue of a bearing assembly (bearing 12*a*), the articulated shaft 20, 21 is not capable of rotating around the rotation axis A and, therefore, a swivel motion of the trunnion 9*b* is not transmitted to the front wheel 6, either. Thus, the front wheel 6 is disconnected from steering performed by means of the handlebar 9. By virtue of the articulated shaft 20, 21, however, the connecting mechanism 10 can be pivoted from the handlebar 9 maximally through the swivel motion β1 about the second swivel axis B. This movement β1 is transmitted to the suspension elements 40 for the weapon 70 and thereby to the weapon 70 itself, which is then capable of pivoting in vertical direction maximally through the deflection angle β2 matching the above-mentioned deflection angle β1 of the handlebar 9. In FIG. 1A, the connecting mechanism 10, the suspension assembly 40 for the weapon 70, and the weapon 70 are depicted in an elevated position with a solid line and in a lowered position with a dashed line.

Aiming the weapon can be performed in many ways. One preferred example of aiming is a camera sight associated with the weapon 70, wherein a weapon-mounted camera 71 is used for transmitting a sighting image to a display placed within the rider's visual field.

The motorcycle 1, preferably the connecting mechanism, comprises locking elements 50 regarding a pivotal movement of the connecting mechanism 10, whereby the swivel motion β1 of the handlebar 9 and thereby also the connecting mechanism 10 can be locked in a stepless fashion to a desired position. The locking elements 50 include a piston-rod equipped cylinder 51, which is attached by its end to an attachment member 53 provided on the crossbar 11 of the connecting mechanism 10 and by a piston rod 52 to a support arm 54 secured to the bracing element 18. The locking elements 50 include also a locking rod 52*a* fitted coaxially within the piston rod 52. The locking rod 52*a*, preferably its end inserted within the cylinder 51, is provided with a clamp, a locking wedge or the like (not shown). A clamp is pressed between the cylinder 51 and the piston rod 52 for example by means of a spring 52*b*, fitted around the other end of the locking rod 52*a* and having its compression force transmitted to the clamp by way of the locking rod 52*a*. Thus, the locking of the piston rod 52*a* results in the connecting mechanism 10 and moreover the weapon 70 becoming locked at a desired deflection angle. The locking is released by applying to the locking rod 52*a* and the spring 52*b* a counter-force to dislodge the clamp from its locking position. The counter-force is produced by means of a cable 52*c*, which is in connection with the locking rod 52*a* and manipulated for example by means of a hand lever (not shown) connected to the other end of the cable. The hand lever resembles in its operating principle the operation of a hand brake in an ordinary bicycle. The release feature can naturally be provided by hydraulic, pneumatic or electric power units.

The gripper 13*b* can be swung (as indicated by arrow T in FIG. 2) for engagement with a second response element 15*c* provided on a second bracket 15 and having a structure similar to the first response element 11*c*. Thereby, the swivel motion α1 of the handlebar 9*b* is transmitted to the first mounting bracket 12 and further to the articulated shaft 20, 21 adapted by way of the gripper 13*b* to be rotatable along with the second bracket 15. The rotary motion of the articulated shaft 20, 21 is further transmitted to the front tire 6. Hence, this position of the gripper 13*b* transmits a swivel motion to the front tire 6 for steering the motorcycle during drive.

In a preferred embodiment of the invention, the bearing seat 4 (which is part of the frame of the motorcycle 1) is provided with an arrester device 25, comprising a pivoting element capable of turning about a pivot axis preferably parallel to the second pivot axis B. The pivoting element comprises a first retainer member 25*a*, manufactured for example in rubber, which can be pivoted for engagement with an engagement lug 32*a* provided on a joint member 32. The purpose of this is to lock the connecting link 30 and thereby the front tire 6 to the front frame 3, 4. Thus, they do not swing about freely in a disturbing manner in the process of directing the weapon 60 and firing the weapon. Hence, the gripper 13*b* is coupled in engagement with the first response element 11*c*.

The arrester device 25 further includes a second retainer member 25*b*, which can be optionally swung for engagement with an engagement lug 18*c* provided on the bracing element 18. The purpose of this is to prevent rotation of the bracing element 18 about the first rotation axis A and thereby swaying or swinging of the weapon 70 in a lateral direction away from a vertical plane extending by the motorcycle's lengthwise centre line. Thus, the gripper 13*b* is coupled in engagement with the second response element 15*c*, the swivel motion α1 of the handlebar 9 being transmitted to the front tire 6. Hence, the motorcycle is drivable, even equipped with a heavy weapon.

FIGS. 5A, 5B, 5C, 6 and 7 illustrate a motorcycle of a second embodiment. It has the forward part of its chassis member 2 provided with a front frame 133, which is associated with pivoting means 100, 130 and 33 adapted to be movable relative to the front frame 133. The pivoting means 100, 130 and 33 are in turn fitted essentially between a handlebar 9 and a front tire 6, whereby turning motions of the handlebar 9 about a trunnion are transmitted during the course of driving (transportation of a weapon) to the front wheel 6 for steering the motorcycle 1. The handlebar 9 is designed to be substantially U-shaped. The handlebar 9 is connected at its bottom part to a swivel arm 120, the swivelling motion of which is transmitted by way of a trunnion 122, 134 to a pivoting member 130. Between two U-legs of the handlebar is left a space 2' used for extending the front part of a weapon 70 forward of the motorcycle 1. The front frame 133 constitutes a base to which a front fork 33 included in the pivoting means is bearing-mounted by way of the pivoting member 130 to be pivotable relative to the chassis 2. The pivoting member 130 comprises two elements and between its two spaced-apart elements is retained the front frame 133. The pivoting member 130 is bearing-mounted to the front frame 133, for example by way of a segment 134 of the trunnion passed through the front frame 133.

FIG. 6 visualises a connecting mechanism 100 mounted adjacent to the pivoting member 130 and the chassis 2, above the latter. FIG. 6 shows the connecting mechanism in a driving mode. The connecting mechanism 100 comprises an elongated plate-like body 101, which is bearing-mounted at its first end pivotably to a bearing-link element 150 coupled with the chassis 2. The bearing-link element 150 is set a distance behind the front frame 133 (in the direction of the motorcycle's longitudinal axis). The connecting mechanism 100 has its second end extending preferably in the direction of the longitudinal axis forward of the front frame 133. The second end is provided with suspension elements 113 for suspending the forward part of the weapon 70. The suspension elements 113 include a bearing-mounted slide bushing, upon which a slide bar 70*a* attached to the weapon 70, and thus the weapon itself, is adapted to slide above the connecting mechanism 100 as the weapon 70 is swivelled in vertical and horizontal directions, which directions have been described in connection with the first embodiment.

Means are fitted in association with the connecting mechanism 100, between its first and second ends, which enable coupling of the handlebar 9 optionally either to the weapon 70 for directing it by means of the handlebar 9 or to the front fork 33 for steering the motorcycle 1. These means will now be described more closely with reference to FIGS. 6 and 7.

The connecting mechanism 100 has its body 101 provided, as a lengthwise extension of the above-mentioned trunnion segment 134, with an extension element 122 for the trunnion. The end of the extension element 122, which remains on the side closer to the pivoting member 130, is fitted with a flange 123 and the latter is in turn provided with at least two gripping studs 124. Upon steering the motorcycle, the connecting mechanism 100 is engaged by way of the gripping studs 124 with the pivoting member 130. Thus, a turning motion of the handlebar 9 is transmitted through the swivel arm 120 of the handlebar 9 to a trunnion composed of the two above-mentioned segments 122 and 134 and thence further to the pivoting members 130 and the front fork 33.

In a longitudinal sense of the motorcycle, the connecting mechanism 100 is designed with a pocket 102 behind the trunnion 122, 134. The pocket 102 is fitted with a plate body 103 which is adapted to move in the pocket 102 lengthwise of the connecting mechanism 100. The plate body 103 is provided with elements enabling other connections, as well. The plate body 103 is provided with a first bracket 104 which has been introduced through a pass-through slot (not shown) formed in a bottom of the pocket 102. The bracket 104 has its end 105 extending a distance away from a bottom level of the connecting mechanism 100 and constitutes a clamping claw 105. The clamping claw 105 has a surface which bears against a retainer element 125 provided on the chassis 2. On the side of the plate body 103 opposite to the first bracket 104 there is provided a second bracket 107 to travel along with the plate body 103. The bracket 107 is fitted immediately behind the handlebar's swivel arm 120 (in a longitudinal sense of the motorcycle 1) during the course of driving. As an extension of the second bracket 107, extending away from the plate body 103, there is provided a flange 107*a* traveling along with the bracket 107. In the proximity of its first end, the connecting mechanism 100 is provided with an end flange 106 set behind the bracket 107 to be stationary relative to the connecting mechanism 100. Between the movable flange 107*a* and the stationary flange 106 is fitted a spring 108, applying a force to the movable flange 107*a* to urge the plate body 103 away from the first end of the connecting mechanism 100.

As a result, the plate body 103 has its first bracket 104 pressed by the spring 108 against the retainer element 125 to position the plate body 103 in place. The second bracket 107 is dimensioned and included in the plate body 102 in such a way that, in its position during the drive, the bracket 107 does not extend far enough to engage in a recess 111 formed in the handlebar's 9 swivel arm 120, whereby the swivel arm 120 is unimpeded to rotate about the above-mentioned trunnion 122, 134. Between the movable flange 107*a* and the end flange 106 is fitted a release member 109, for example an elongated lever, whereby the plate body 103 can be moved in a direction counter to the spring force. The lever 109 is coupled to the plate body 103 by way of a joint 109*a*, the lever turning about the pivot axle of said joint. The plate body 103 has its rear portion formed with a push bracket 110, against which the lever 109 can be pushed for moving the plate body 103. When the force applied to the push bracket 110 by means of the lever 109 exceeds that of the spring 108, the plate body 103 starts moving towards the first end of the connecting mechanism 100.

Upon dislodging the plate body 103 this way from its driving-mode position, the clamping claw 105 present at the end of the first bracket 104 will also be dislodged from holding the retainer element 125. Hence, the connecting mechanism 100 is released and thereby said connecting mechanism 100 can be swivelled about a rotation axis B/151, which is present at the first end of the connecting mechanism 100 and crosswise to the motorcycle's 1 longitudinal axis. It should be noted that the connecting mechanism 100 has such a swivelling motion that the flange 123 has its gripping studs 124 disengage along with the connecting mechanism 100 from the pivoting member 130, thus releasing the pivoting member 130 and the front fork 33 from a steering mode. At the same time, the body has its clamping claw 105 moving past the retainer element 125. Preferably, the connecting mechanism 100 has means associated therewith, by which means a dislodgement of the clamping claw 105 from holding the retainer element 125 serves to immobilize the front fork 33 and the front tire 6. Firstly, these means include an elongated arm 140 disposed on the chassis 2 alongside the front frame 133. It is adapted to swivel at its first end about a pivot axle 141 which is transverse to the motorcycle's longitudinal axis. The arm 140 has its second end provided with a lip 142 which includes a facet. The facet is designed for applying a force to a facet formed in the clamping claw 105, which force contributes to a dislodgement of the clamping claw and thereby the plate body 103 from holding the retainer element 125 and further to a pivoting motion thereof past the retainer element 125. The arm 140 has its strength delivered by a spring 143, which uses its inherent force to push a facet formed in the arm against a facet formed in the clamping claw 125. In addition, the arm 140 has its second end constitute an engagement lug 144 which, as the arm 140 rotates (in response to the spring 143), pivots into the engagement with the pivoting member 130. For the engagement, the pivoting member 130 has rear portion provided with a retainer slot 132. With this arrangement, the front fork 33 and the front tire 6 can be locked in a single position as the weapon 70 is connected to the handlebar 9 to be swivelled thereby.

Thereafter, the pivoting lever 109 can be released, whereby the plate body 103 travels in a direction which is opposite relative to a force applied by the lever in response to the spring 108. The plate body 103 travels so far in this direction that the bracket 107 reaches the recess 111 formed in the handlebar's 9 swivel arm 120. Thereby, a pivoting motion of the handlebar's swivel arm 120, as well as that of the handlebar 9 itself, relative to the connecting mechanism 100 is blocked. Hence, the weapon 70, which is suspended on the connecting mechanism 100 as described above, has become coupled to the handlebar 9 for aiming. The weapon 70 can be aimed in vertical and horizontal directions by pivoting the connecting mechanism 100 about rotation axes A and B provided adjacent to the first end of the connecting mechanism.

The invention is particularly applicable to weapons as follows: automatic grenade launcher, machine gun in various calibers, bazooka, various missiles and high-powered sniper rifles. The motorcycle can be further fitted with various types of surveillance equipment, such as a dark vision device and a listening device. It is easy to carry along a variety of electronic warfare equipment, such as jamming equipment and communication equipment (e.g. transmission of an image).

The inventive weapon-equipped motorcycle is particularly useful for applications as follows:

1. Deep strikes into enemy territory
   guerrilla warfare
   demolition operations
   nuisance operations
   surprise raids
   reconnaissance operations
2. Urban warfare
3. Patrolling and border control
4. Protecting convoys
5. The system can be applied not only to these military duties
   but also to police service
   against criminal gangs
   for internal order The present invention is not limited solely to the foregoing embodiment as its structural design can be subjected to a multiplicity of variations within the scope of protection defined by the attached claims. For example, the procedures of directing a weapon can be performed not only mechanically but also hydraulically, electrically or pneumatically or as combinations thereof. For horizontal directing, i.e. lateral directing, for example, the weapon can be supported on a linear bearing or a curvilinear bearing and the transmission of weapon directing forces takes place hydraulically.

For winter service, the front wheel can be supplemented by the addition of a front ski and the rear wheel can be replaced with a wider-than-wheel track mat for an improved load capacity and mobility in deep snow.

The invention claimed is:

1. A motorcycle, which is equipped with a weapon, as well as with a front and rear wheel or a front ski and a rear-located track mat, said motorcycle comprising a chassis member, a front frame attached to the chassis member, a handlebar, a pivoting device fitted between the handle bar and the front wheel or ski, and by which pivoting device the turning motions of the handle bar are transmissible to the front wheel or ski for steering the motorcycle, wherein the pivoting device is provided with suspension elements for the weapon, by which the weapon is connected to the pivoting device for directing the weapon by the handlebar, and that the pivoting device includes a connecting mechanism, comprising switch-over elements for removably connecting the weapon to the handlebar whereby the weapon is connectable to the handlebar or disconnectable from this engagement with the handlebar to use the handlebar for steering the motorcycle.

2. A motorcycle as set forth in claim 1, wherein between the chassis and the handlebar is a void space, which accommodates a heavy weapon and which space enables directing the weapon by swiveling the weapon relative to the chassis member both in vertical and horizontal direction.

3. A motorcycle as set forth in claim 2, wherein the chassis member is fitted with a mounting, having the heavy weapon pivotably attached thereto by a rear portion of the weapon.

4. A motorcycle as set forth in claim 1, wherein the handlebar is fitted with a trunnion linked by way of the connecting mechanism to the pivoting device, and that the connecting mechanism is provided with a second pivot axis, which is transverse to the trunnion and about which the handlebar is pivotable for directing the weapon in vertical direction.

5. A motorcycle as set forth in claim 4, wherein the motorcycle comprises clamping elements, whereby the turning motion of the handlebar about the transverse second pivot axis can be locked to a desired deflection angle.

6. A motorcycle as set forth in claim 1, wherein the front frame is provided with two bearings, the first of said bearings having the connecting mechanism mounted thereon for movement relative to the frame and the second bearing having a swivel element included in the pivoting device mounted thereon for rotation about the frame, and that the frame is provided with an arrester means for locking the connecting mechanism immovably relative to the frame or for locking the swivel element non-rotatably relative to the frame.

7. A motorcycle as set forth in claim 1, wherein the suspension elements are attached to the weapon or support the weapon at a location forward of the handlebar.

8. A motorcycle, which is equipped with a weapon, as well as with a front and rear wheel or a front ski and a rear-located track mat, said motorcycle comprising a chassis member, a front frame attached to the chassis member, a handlebar, a pivoting device fitted between the handle bar and the front wheel or ski, and by which pivoting device the turning motions of the handle bar are transmissible to the front wheel or ski for steering the motorcycle, wherein the pivoting device is provided with suspension elements for the weapon, by which the weapon is connected to the pivoting device for directing the weapon by the handlebar, and that the pivoting device includes a connecting mechanism, comprising switch-over elements whereby the weapon is connectable to the handlebar or disconnectable from this engagement with the handlebar to use the handlebar for steering the motorcycle, wherein the handlebar is fitted with a trunnion linked by way of the connecting mechanism to the pivoting device, and that the connecting mechanism is provided with a second pivot axis, which is transverse to the trunnion and about which the handlebar is pivotable for directing the weapon in vertical direction.

9. A motorcycle, which is equipped with a weapon, as well as with a front and rear wheel or a front ski and a rear-located track mat, said motorcycle comprising a chassis member, a front frame attached to the chassis member, a handlebar, a pivoting device fitted between the handle bar and the front wheel or ski, and by which pivoting device the turning motions of the handle bar are transmissible to the front wheel or ski for steering the motorcycle, wherein the pivoting device is provided with suspension elements for the weapon, by which the weapon is connected to the pivoting device for directing the weapon by the handlebar, and that the pivoting device includes a connecting mechanism, comprising switch-over elements whereby the weapon is connectable to the handlebar or disconnectable from this engagement with the handlebar to use the handlebar for steering the motorcycle, wherein the front frame is provided with two bearings, the first of said bearings having the connecting mechanism mounted thereon for movement relative to the frame and the second bearing having a swivel element included in the pivoting device mounted thereon for rotation about the frame, and that the frame is provided with an arrester means for locking the connecting mechanism immovably relative to the frame or for locking the swivel element non-rotatably relative to the frame.

10. The motorcycle as set forth in claim 9, wherein the motorcycle comprises clamping elements, whereby the turning motion of the handlebar about the transverse second pivot axis can be locked to a desired deflection angle.

* * * * *